US007207192B2

(12) United States Patent
Ronczy

(10) Patent No.: US 7,207,192 B2
(45) Date of Patent: Apr. 24, 2007

(54) SECONDARY DEETHANIZER TO DEBOTTLENECK AN ETHYLENE PLANT

(75) Inventor: Stephen Edward Ronczy, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 413 days.

(21) Appl. No.: 10/710,676

(22) Filed: Jul. 28, 2004

(65) Prior Publication Data

US 2006/0021379 A1 Feb. 2, 2006

(51) Int. Cl.
*F25J 3/00* (2006.01)

(52) U.S. Cl. ..... 62/630

(58) Field of Classification Search ..... 62/620, 62/630, 631

See application file for complete search history.

(56) References Cited

U.S. PATENT DOCUMENTS

| | | | | | |
|---|---|---|---|---|---|
| 2,271,761 | A * | 2/1942 | Coulter et al. | 208/345 |
| 3,477,946 | A * | 11/1969 | Borst, Jr. | 208/344 |
| 3,622,504 | A * | 11/1971 | Strum | 95/288 |
| 4,115,086 | A * | 9/1978 | Jordan et al. | 62/622 |
| 5,678,424 | A | 10/1997 | Nazar | 62/630 |
| 5,709,780 | A | 1/1998 | Ognisty et al. | 202/158 |
| 5,755,933 | A | 5/1998 | Ognisty et al. | 202/158 |
| 5,791,161 | A * | 8/1998 | Manley | 62/630 |
| 5,884,504 | A | 3/1999 | Nazar | 62/630 |
| 5,960,643 | A * | 10/1999 | Kuechler et al. | 62/620 |
| 6,907,752 | B2 * | 6/2005 | Schroeder et al. | 62/620 |
| 2005/0107650 | A1 * | 5/2005 | Sumner | 585/324 |

* cited by examiner

*Primary Examiner*—William C. Doerrler
(74) *Attorney, Agent, or Firm*—Lundeen & Dickinson LLP

(57) ABSTRACT

A process for deethanizing light hydrocarbons comprising olefins is disclosed. A feed stream, comprising ethylene, ethane, propylene, and propane, is supplied to a primary deethanizer 24, having absorption and stripping sections. The absorption section produces an overhead vapor effluent 128, consisting primarily of ethylene and ethane, which is supplied to a C2 splitter to separate ethane and ethylene. The stripping section produces a primary deethanizer bottoms stream having an ethane concentration from 1 to 20 mole percent of the feed ethane. The primary deethanizer bottoms 120 are cooled and supplied to a secondary deethanizer 142 having absorption and stripping sections. The absorption section is refluxed, producing an overhead effluent 154 essentially free of ethylene. The stripping section is refluxed to produce a secondary deethanizer bottoms stream essentially free of ethane. The secondary deethanizer bottoms stream is supplied to a depropanizer or C3 splitter for separation of the remaining olefins.

21 Claims, 2 Drawing Sheets

SECONDARY DEETHANIZER TO DEBOTTLENECK AN ETHYLENE PLANT

BACKGROUND OF INVENTION

This invention relates to an improved method for recovery of ethylene and more particularly to the addition of a secondary deethanizer to an existing ethylene plant having at least one deethanizer for the improved fractionation of ethane and ethylene.

Ethylene is a building block in the manufacturing of a wide variety of chemical materials and is typically produced industrially by pyrolysis of hydrocarbons in a furnace in the presence of steam. The furnace effluent stream comprising a range of components is typically cleaned up, dried to remove water, compressed and passed to an olefins recovery section to separate the ethylene from other light hydrocarbons, such as ethane, propylene, propane, and the like.

The order of removal of compounds from the furnace effluent can begin with either a demethanizer, deethanizer, or a depropanizer. FIG. 1 illustrates a flow pattern that is generally representative of prior art demethanizer-first fractionation processes. The effluent 10 from the cracking furnaces (not shown) can be cooled and compressed and enters the first fractionation tower, demethanizer 12, which removes methane and lighter compounds. The light compounds exit the overhead of the demethanizer 12 via line 14 and can enter a cold box 16 where they can be separated into a hydrogen rich tail gas stream 18 and a methane-rich gas stream 20. The remainder of the furnace effluent leaves the bottom of the demethanizer via line 22 and is supplied to the deethanizer 24.

The deethanizer 24 separates the demethanizer bottoms effluent into C2s and lighter compounds which exit the overhead of the deethanizer 24 as vapor via line 26 and a heavier portion which exits via line 28 as deethanizer bottoms. The overhead C2s can be cycled through a reactor (not shown) to remove any acetylene and then fed to a C2 splitter 30 to produce ethylene-rich stream 32 and ethane-rich stream 34.

The deethanizer bottoms are fed to the depropanizer 36 where C3s and lighter compounds exit the overhead of the depropanizer via line 38 and can be supplied to a reactor (not shown) to remove methyl acetylene and propadiene. The C3s are then supplied to a C3 splitter 42 which separates propylene 44 and propane 46. The depropanizer bottoms are fed to a debutanizer via line 40. The debutanizer 48 recovers the C4s as a mixed overhead effluent 50. C5 and heavier compounds which exit as debutanizer bottoms via line 52 can be recycled to the cracking furnaces (not shown).

In U.S. Pat. Nos. 5,678,424 and 5,884,504, Nazar discloses improvements to the fractionation of ethylene by adjusting the number of rectification trays. In U.S. Pat. Nos. 5,709,780 and 5,755,933, Ognisty et al. disclose a partitioned distillation column combining a distillation column with an upstream stripper/absorber. All patents and publications referred to herein are hereby incorporated by reference in their entirety.

A major operating consideration in existing deethanizer columns is the strict requirement for low C2 content in deethanizer bottoms. Typically, prior art deethanizers require a C2 concentration in the deethanizer bottoms of less than 200 mol ppm. To achieve such a high recovery rate in the deethanizer with a front-end demethanizer design, the bottoms are often reboiled at high temperatures, resulting in high fouling rates in the reboiler. Currently, to address the high fouling rates in ethylene plants, multiple redundant reboilers can be installed.

SUMMARY OF INVENTION

The present invention is directed to a method of retrofitting an existing olefin fractionation plant by supplementing an existing deethanizer with a second deethanizer, thereby increasing deethanizer capacity and allowing for reduced reboiling requirements in the deethanizer to reduce or eliminate fouling rates.

The present invention provides, in one embodiment, a process for deethanizing a light hydrocarbon stream. The process includes the steps of: (a) feeding one or more light hydrocarbon streams comprising ethylene, ethane, propylene and propane to a primary deethanizer having absorption and stripping sections at a primary deethanizer pressure; (b) refluxing the absorption section of the primary deethanizer to produce a rectified stream or streams containing less than 1 mole percent propylene and propane, wherein the rectified stream or streams together comprise from 80 to 99 percent of the feed ethane; (c) reboiling the stripping section of the primary deethanizer to produce a primary deethanizer bottoms stream comprising from 1 to 20 percent of the feed ethane; (d) feeding the primary deethanizer bottoms stream to a secondary deethanizer having absorption and stripping sections at a pressure less than the primary deethanizer pressure; (e) refluxing the absorption section of the secondary deethanizer to produce an overhead vapor stream of ethane essentially free of ethylene; and (f) reboiling the stripping section of the secondary deethanizer to produce a deethanized stream essentially free of ethane.

The primary deethanizer reboiling can be maintained at a temperature less than 80° C. (175° F.). The heat for the secondary deethanizer reboiling can be supplied by hot water. Alternatively, the heat for the secondary deethanizer reboiling can be supplied by condensing propylene refrigerant. The heat for the primary deethanizer reboiling can be provided by steam. The primary deethanizer bottoms stream can comprise from 10 to 12 percent of the feed ethane and the overhead vapor stream from the secondary deethanizer can comprise less than 1 mole percent ethylene. The process can further include supplying the overhead vapor stream from the secondary deethanizer to cracking furnace feedstock. The process can further include supplying the overhead vapor stream from the secondary deethanizer to burner fuel. The deethanized stream can include less than 0.5 mole percent ethane.

In another embodiment, the invention provides an improvement to a process for recovering olefins from a cracking furnace effluent. The process includes compression of the effluent with a process gas compressor followed by fractionation in a demethanizer, deethanizer, depropanizer, debutanizer, C2 splitter and C3 splitter to obtain purified streams of at least ethane, ethylene, propane, and propylene. The improvement comprises fractionation in a deethanizer including the steps of: (a) feeding one or more light hydrocarbon streams comprising ethylene, ethane, propylene and propane to a primary deethanizer having absorption and stripping sections at a primary deethanizer pressure; (b) refluxing the absorption section of the primary deethanizer to produce a rectified stream or streams containing less than 1 mole percent propylene and propane, wherein the rectified stream or streams together comprise from 80 to 99 percent of the feed ethane; (c) reboiling the stripping section of the primary deethanizer to produce a primary deethanizer bottoms stream comprising from 1 to 20 percent of the feed ethane; (d) feeding the primary deethanizer bottoms stream to a secondary deethanizer having absorption and stripping sections at a pressure less than the primary deethanizer pressure; (e) refluxing the absorption section of the secondary deethanizer to produce an overhead vapor stream of ethane essentially free of ethylene; and (f) reboiling the stripping section of the secondary deethanizer to produce a deethanized stream essentially free of ethane.

The improvement can further include removing the overhead ethane stream from the process, such as, for example, feeding the overhead ethane stream to the cracking furnace. The secondary deethanizer can be refluxed with liquid ethane recovered from the C2 splitter. The process can employ a front-end demethanizer, from 10 to 12 percent of the feed ethane can be recovered in the primary deethanizer bottoms stream, and the primary deethanizer reboiling can be at a temperature less than 80° C. (175° F.). The process can employ a front-end demethanizer and heat for the secondary deethanizer reboiling can be supplied by hot water. The process can employ a front-end depropanizer and heat for the secondary deethanizer reboiling can be supplied by condensing propylene refrigerant.

Another embodiment of the present invention provides an apparatus for deethanizing a light hydrocarbon stream comprising olefins. The apparatus includes: (a) means for feeding one or more light hydrocarbon streams comprising ethylene, ethane, propylene and propane to a primary deethanizer having absorption and stripping sections at a primary deethanizer pressure; (b) means for refluxing the absorption section of the primary deethanizer to produce a rectified stream or streams containing less than 1 mole percent propylene and propane, wherein the rectified stream or streams together comprise from 80 to 99 percent of the feed ethane; (c) means for reboiling the stripping section of the primary deethanizer to produce a primary deethanizer bottoms stream comprising from 1 to 20 percent of the feed ethane; (d) means for feeding the primary deethanizer bottoms stream to a secondary deethanizer having absorption and stripping sections at a pressure less than the primary deethanizer pressure; (e) means for refluxing the absorption section of the secondary deethanizer to produce an overhead vapor stream of ethane essentially free of ethylene; and (f) means for reboiling the stripping section of the secondary deethanizer to produce a deethanized stream essentially free of ethane.

In another embodiment, the invention provides a method for retrofitting an original olefin separation unit, wherein the original olefin separation unit comprises a process gas compressor, a demethanizer, an original deethanizer, a depropanizer, a C2 splitter and a C3 splitter, and the original deethanizer comprises absorption and stripping sections, for the separation of ethylene and ethane from an olefin feed gas stream. The method includes the steps of: (a) installing a secondary deethanizer having absorption and stripping sections downstream from the original deethanizer; (b) supplying one or more light hydrocarbon streams comprising ethylene, ethane, propylene and propane to the original deethanizer operating as a primary deethanizer having absorption and stripping sections at a primary deethanizer pressure; (c) refluxing the absorption section of the primary deethanizer to produce a rectified stream or streams containing less than 1 mole percent propylene and propane, wherein the rectified stream or streams together comprise from 80 to 99 percent of the feed ethane; (d) reboiling the stripping section of the primary deethanizer to produce a primary deethanizer bottoms stream comprising from 1 to 20 percent of the feed ethane; (e) supplying the primary deethanizer bottoms stream to the secondary deethanizer; (f) refluxing the absorption section of the secondary deethanizer to produce an overhead vapor stream of ethane essentially free of ethylene; and (g) reboiling the stripping section of the secondary deethanizer to produce a deethanized stream essentially free of ethane.

The reboiling of the primary deethanizer can be at a temperature less than 80° C. (175° F.). The bottoms stream from the primary deethanizer can comprise from 10 to 12 percent of the feed ethane and the overhead vapor stream from the secondary deethanizer can comprise less than 1 mole percent ethylene. The method can further include supplying the overhead vapor stream from the secondary deethanizer to cracking furnace feedstock. The deethanized stream can comprise less than 0.5 mole percent ethane.

DETAILED DESCRIPTION

Detailed embodiments of the present invention are disclosed herein. However, it is understood that the disclosed embodiments are merely exemplary of the invention, which can be embodied in various forms. Specific structural and functional details disclosed herein are not intended to be limiting, but are merely illustrations that can be modified within the scope of the attached claims.

Figure 2:
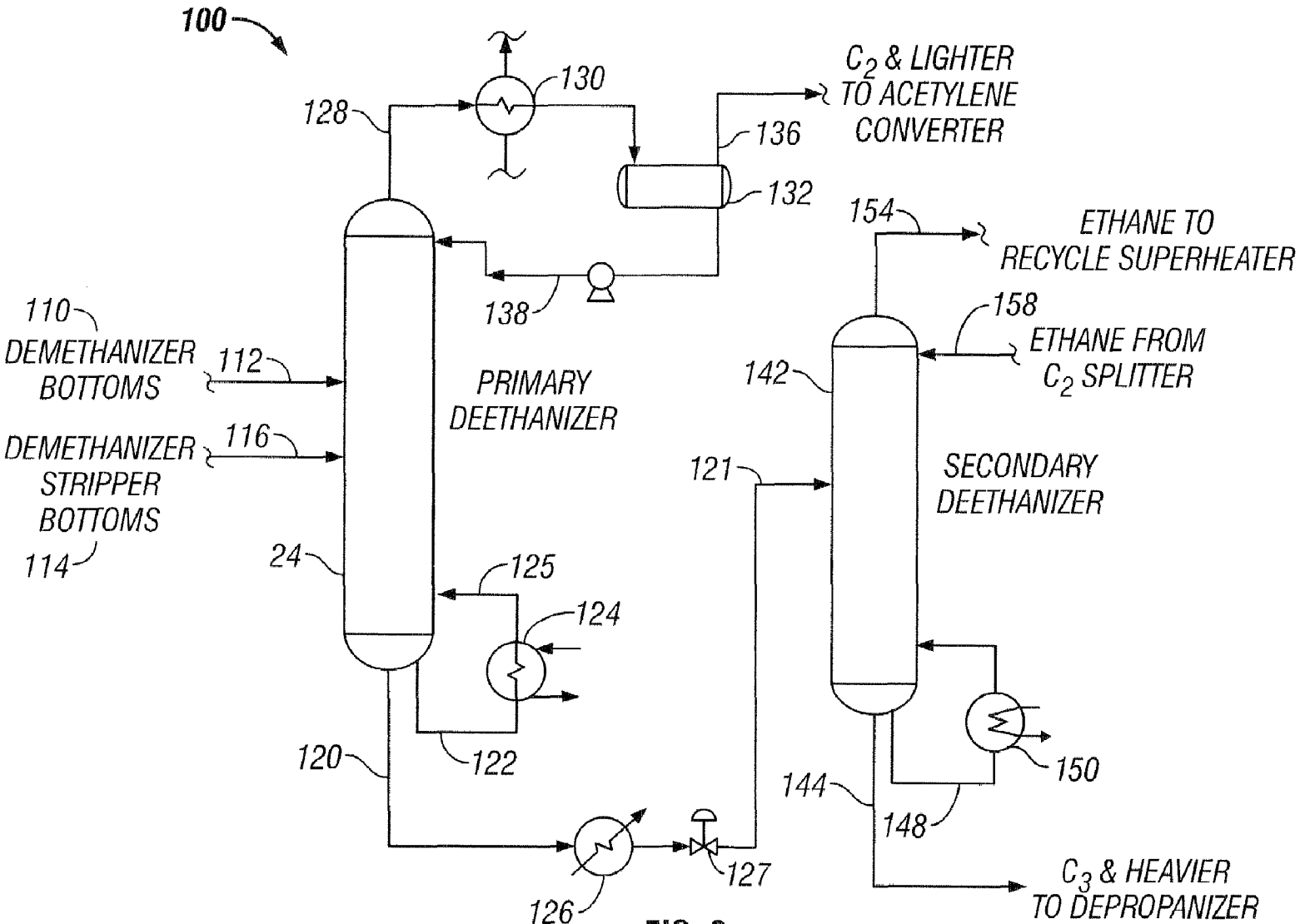
FIG. 2 is a schematic illustration of one embodiment of the present invention wherein a secondary deethanizer column has been added to an original ethylene recovery process.

With reference to FIG. 2, the retrofit of an existing deethanizer plant is disclosed wherein a secondary deethanizer 142 is added to the existing primary deethanizer to debottleneck and reduce fouling in the reboilers. An existing primary deethanizer 24 having an upper absorption section and a lower stripping section is provided. Overhead vapors can exit via line 128, which can include a heat exchanger 130, and can supply reflux drum 132. Reflux drum 132 can feed the gas effluent via line 136 to an acetylene converter (not shown). The reflux drum 132 can include a recycle line 138 to the absorption section of primary deethanizer 24 and can include a pump to facilitate transport. The primary deethanizer can include a reboiler section, where primary deethanizer bottoms can be supplied via line 122 to heat exchanger 124 and return line 125.

The primary deethanizer 24 has a bottoms line 120, which can include a heat exchanger 126 and a flow control valve 127, and can supply the secondary deethanizer 142. The secondary deethanizer 142 has an overhead effluent line 154 and a secondary deethanizer bottoms line 144, and can include a reboiler section where the secondary deethanizer bottoms can be supplied via line 148 to heat exchanger 150.

The addition of a secondary deethanizer 142 to an existing ethylene recovery unit having an original deethanizer 24 is applicable in connection with either a front-end demethanizer flow scheme, a front-end deethanizer flowscheme, or a front-end depropanizer flow scheme. The primary deethanizer 24 can include upper and lower sections, wherein the upper section functions as an absorber, in which residual C3 and any heavier hydrocarbons are removed from corresponding ethylene and ethane vapors to obtain a C3-lean overhead product via line 128. If desired, an ethylene-ethane mixture can be recovered as a side stream (not shown) and ethylene can be recovered overhead. The advanced deethanizer, such as has been previously disclosed in U.S. Pat. No. 5,884,504 to Nazar, can be used as the primary deethanizer. The advanced deethanizer features between 30 and 40 additional trays and can provide an overhead stream of essentially pure ethylene, a mixed side stream of ethylene and ethane, and a bottoms stream of between 1 and 12 mol % ethane, and heavier hydrocarbons. The lower section of the primary deethanizer 24 acts as a stripper where undesired heavy compounds are removed and supplied downstream. The primary deethanizer 24 can include a plurality of trays or packed beds, or a combination thereof. The primary deethanizer 24 desirably has between 20 and 35 absorber trays and between 20 and 35 stripper trays. It is understood that the deethanizer columns 24, 142 can have different configurations, sections and feed points.

In relaxing the strict ethane specification of the prior art and allowing a C2 content in the primary deethanizer bottoms stream 120 of up to 20 mol %, desirably between 10 and 12 mol %, the deethanizer bottoms temperature can be reduced by approximately 6°–9° C. (10°–15° F.). Desirably, the primary deethanizer bottoms temperature of the primary deethanizer is maintained at less than 79° C. (175° F.). As the concentration of C2 material in the primary deethanizer bottoms is increased, the bottoms temperature can be decreased. When C2 content in the primary deethanizer bottoms is maintained at approximately 10 mol %, the C2 content in the primary deethanizer bottoms can contain greater than 99 mol % ethane, desirably having only a fractional amount of ethylene present. Total recovery of C2 material from the primary and secondary deethanizers 24, 142 can exceed 99 mol % of C2 present in the initial feed. Total ethylene plant volume can be increased as greater concentrations of C2 material are allowed in the primary deethanizer bottoms and the load for the C2 splitter is reduced accordingly.

With reference to the deethanizer provided in FIG. 2, in operation a charge gas of mixed olefins from a hydrocarbon cracking furnace (not shown) is fed to a demethanizer (not shown) where methane and lighter compounds are separated from the mixture. The demethanized effluent stream or streams, substantially free of methane and consisting of a mixture containing ethylene, ethane, propylene, propane, and other hydrocarbons, are separated as demethanizer bottoms and demethanizer stripper bottoms which are then supplied to primary deethanizer 24 via lines 112 and 116 respectively.

The primary deethanizer 24 provides an upper absorption section and a lower stripping section, and is desirably maintained at a pressure of between 2.6 and 2.9 MPa (375 and 425 psia), and a temperature of between 74° and 79° C. (165° and 175° F.). The feed is supplied to the primary deethanizer 24 in a conventional manner. Acetylene, ethylene, and ethane are collected overhead from the absorption section in stream 128, and less volatile compounds flow downward in the primary deethanizer 24 to the stripping section. In the stripping section, the more volatile compounds from the feed are stripped out by an upwardly flowing vapor. The heavier liquid compounds, such as propane and propylene, flow downward, and are recovered as a bottoms stream 120 from the stripping section.

Primary deethanizer overhead stream 128 consists mainly of ethylene and ethane, and trace amounts of acetylene, and can have a temperature of between −20° and 0° C. (−4° and 32° F.). The presence of the secondary deethanizer generally does not serve to significantly reduce the temperature of the overhead C2 material recovered when compared with a fractionation process having a single deethanizer. However, the overhead stream 128 of the present invention can have a lower proportion of ethane, which can allow for an increased processing rate and/or more efficient ethylene-ethane distillation. The primary overhead stream 128 can be partially condensed in a heat exchanger 130 supplied with propylene refrigerant, or alternatively supplied with a side draw stream of ethane from the C2 splitter. The reflux drum 132 recovers the condensed hydrocarbons, which are used to reflux the deethanizer 24 via line 138. A vapor stream can be supplied from the reflux drum 132, via line 136, to a conventional acetylene converter (not shown), if desired, and then to a C2 splitter (not shown) for separation of ethylene and ethane in a conventional manner known to those in the art. The C2 splitter can be any commercially available C2 splitter.

The primary deethanizer bottoms are heated in a reboiler 124 via line 122, where they can be indirectly heated with steam, hot water, or any other suitable heat source, to provide hot stripping vapors that remove C2 from the C3 and heavier liquid hydrocarbon compounds. The reboiler return can be fed to the primary deethanizer 24 via line 125 at a temperature of, for example, between 77° and 79° C. (17° and 175° F.) in a front-end demethanizer flow scheme. The temperature of the reboiler in the present invention can be reduced due to the presence of the secondary deethanizer and relaxed C2 requirements, from a temperature between 86° and 95° C. (186° and 203° F.) required when the secondary deethanizer 142 is not installed. In the case of a front-end depropanizer flow scheme where a secondary deethanizer is present, the reboiler temperature can be reduced from between 72° and 78° C. (140° and 150° F.) to between 52° and 57° C. (125° and 135° F.).

Primary deethanizer bottoms exit via line 120 at a temperature between 71° and 79° C. (16° and 175° F.) and consist primarily of propylene and propane, and can have an ethane content of from 1 to 20 mol %, desirably between 10 and 12 mol %. A cold water exchanger 126 can be positioned in line 120 between the primary and secondary deethanizers 24, 142 to cool the bottoms to a temperature between 55° and 65° C. (131° and 149° F.), for example. A valve 127 can be positioned downstream from the heat exchanger 126 to control the flow of the primary deethanizer bottoms to the secondary deethanizer 142. The primary deethanizer bottoms can be supplied to a secondary deethanizer 142 via line 121, at a temperature between 27° and 49° C. (80° and 120° F.) and a pressure between 1.1 and 1.4 MPa (160 and 200 psia), for example.

The secondary deethanizer 142, which can have approximately 30% fewer distillation trays than primary deethanizer 24, recovers the C2 material present in the primary deethanizer bottoms effluent from the C3 and heavier compounds. Desirably, the secondary deethanizer 142 has between 10 and 15 absorption trays and between 20 and 35 stripper trays.

Secondary deethanizer 142 can be supplied with an ethane-rich stream from C2 splitter (not shown) via line 158, which can be utilized as a reflux solvent. Secondary deethanizer 142 yields an overhead product 154 that can consist of between 85 and 95 mol % ethane, for example, with minor amounts of ethylene and propylene. The ethane stream 154 can be recycled to the furnace for cracking (not shown), blended with the effluent of the ethane recycle vaporizer, or used as fuel. Desirably, the ethane content in the secondary deethanizer overhead product 154 is greater than 90 or 95%. Desirably, the pressure difference between the secondary deethanizer 142 and the cracking furnaces enables the overhead vapor to flow by pressure difference from the secondary deethanizer 142 to the cracking furnace (not shown). Additionally, the overhead vapor, which consists primarily of ethane, can be condensed with propylene refrigeration to provide a liquid product which can then be blended with an ethane recycle stream upstream from an ethane recycle vaporizer (not shown).

The secondary deethanizer 142 bottoms are heated in reboiler 150 via line 148, where they are indirectly heated with hot water, or another suitable heat source to provide hot stripping vapors. The reboiler return can be fed to the secondary deethanizer at a temperature between 32° and 49° C. (90° and 120° F.) in a front-end demethanizer scheme. In a front-end depropanizer flow scheme the reboiler temperature can be between 15° and 18° C. (60° and 65° F.). The secondary deethanizer bottoms, consisting primarily of propylene, propane and heavier compounds and having a C2 content which is desirably less than 0.5 mol %, exit via line 144, desirably at a temperature between 32° and 49° C. (90° and 120° F.) and a pressure of less than 1.6 MPa (180 psia). In a demethanizer-first process the secondary deethanizer bottoms 146 can be supplied to a depropanizer. In a front-end depropanizer flow scheme, the secondary deethanizer bottoms 146 can be supplied to a C3 splitter.

The pressure of the primary deethanizer 24 is usually higher than the C2 splitter to allow transfer without pumping, and can generally operate at between 1.5 and 3.5 MPa (230 and 500 psia), desirably between 1.7 and 3.1 MPa (250 and 450 psia). The secondary deethanizer 142 can operate between 0.7 and 1.6 MPa (100 and 225 psia), desirably between 0.8 and 1.0 MPa (120 and 150 psia). The secondary deethanizer 142 desirably operates at a lower pressure than the primary deethanizer 24, but at a pressure sufficiently high to enable the overhead product vapor to flow by pressure to the ethane recycle cracking furnace which generally operates at approximately 0.6 MPa (90 psia).

The present invention can be advantageously used in situations where the deethanizer is a processing bottleneck. The present invention can also be advantageously used where multiple feeds, such as for example liquid based feed crackers result in periodically high C3 production, or where a significant C3 concentration is otherwise present. By installing a secondary deethanizer 142, the strict C2 requirements of the primary deethanizer 24 can be relaxed reducing the reboiling requirement for the primary deethanizer column 24 and the C2 splitter. Furthermore, the C2 recovered overhead from the secondary deethanizer 142 is essentially free of ethylene, so in this sense the addition of the secondary deethanizer to the process achieves C2 splitting, which further reduces the load on the C2 splitter and produces a stream consisting essentially of ethane for recycle to the cracking furnace. Desirably, ethylene content in the secondary deethanizer overhead vapor is less than 1 mol % and ethane content is at least 90 mol %.

Another advantage to the present invention is that the secondary deethanizer 142 can be constructed adjacent to an operating ethylene plant having an original deethanizer while the plant is operating. Connecting the secondary deethanizer 142 to the original deethanizer 24 may require only minimal downtime of the ethylene plant, if any, resulting in minimal losses of production and revenue. Other changes to the original deethanizer 24, such as replacement or modification of the distillation trays, are not necessary as the installation of the secondary deethanizer 142 reduces or eliminates the fouling rates.

EXAMPLE 1

Prior Art

An example of the prior art deethanizer featuring a single deethanizer column is provided. Mole fractions are given in Table 1. The primary deethanizer of the present example has an inside diameter of 3.96 m (13 ft) and a height of 37.5 m (123 ft), and features a total of 63 trays. Demethanizer bottoms 112, consisting of approximately 72.6 mol % ethylene, 21 mol % ethane, 3.3 mol % propylene and 1.6 mol % acetylene, as well as trace amounts of other compounds, are supplied to the primary deethanizer at a rate of 2,975 kgmol/hour (6,558 lbmol/hour), at a temperature of −6° C. (21° F.) and a pressure of 3.1 MPa (449 psia). Similarly, demethanizer stripper bottoms 116, consisting of approximately 45 mol % ethylene, 22.2 mol % ethane, 14.2 mol % propylene, 5.4 mol % propane, 4.0 mol % butadiene, 2.4 mol % benzene, 1.8 mol % isobutylene and 1.4 mol % acetylene, are supplied to the primary deethanizer at a rate of 3,062 kgmol/hour (6,752 lbmol/hour), at a temperature of 14° C. (58° F.) and a pressure of 3.1 MPa (449 psia). The deethanizer produces an overhead effluent 128 at a rate of 4,933 kgmol/hour (10,877 lbmol/hour), having a temperature of −11° C. (12° F.) and a pressure of 2.8 MPa (399 psia), and consists of 71.6 mol % ethylene, 26.4 mol % ethane, 1.8 mol % acetylene, and trace amounts of other compounds. The overhead effluent has a production rate of approximately 2,307 kgmol/hour (5,088 lb/hour) acetylene, 99,218 kgmol/hour (218,740 lb/hour) ethylene and 39,168 kgmol/hour (86,351 lb/hour) of ethane. The deethanizer produces a bottoms effluent 120 at a rate of 1,099 kgmol/hour (2,422 lbmol/hour), having a temperature of 86.4° C. (187.6° F.) and a pressure of 2.8 MPa (409 psia), and consists of 47.5 mol % propylene, 17.8 mol % propane, 11.8 mol % butadiene, 6.7 mol % benzene, 5.3 mol % isobutylene, 2.3 mol % maleic anhydride, 2.2 mol % isoprene, 2.1 mol % cyclopentadiene, 1.6 mol % propadiene, and 1.2 mol % toluene. The mole fractions of selected streams are presented in Table 1.

TABLE 1

Figure 1:
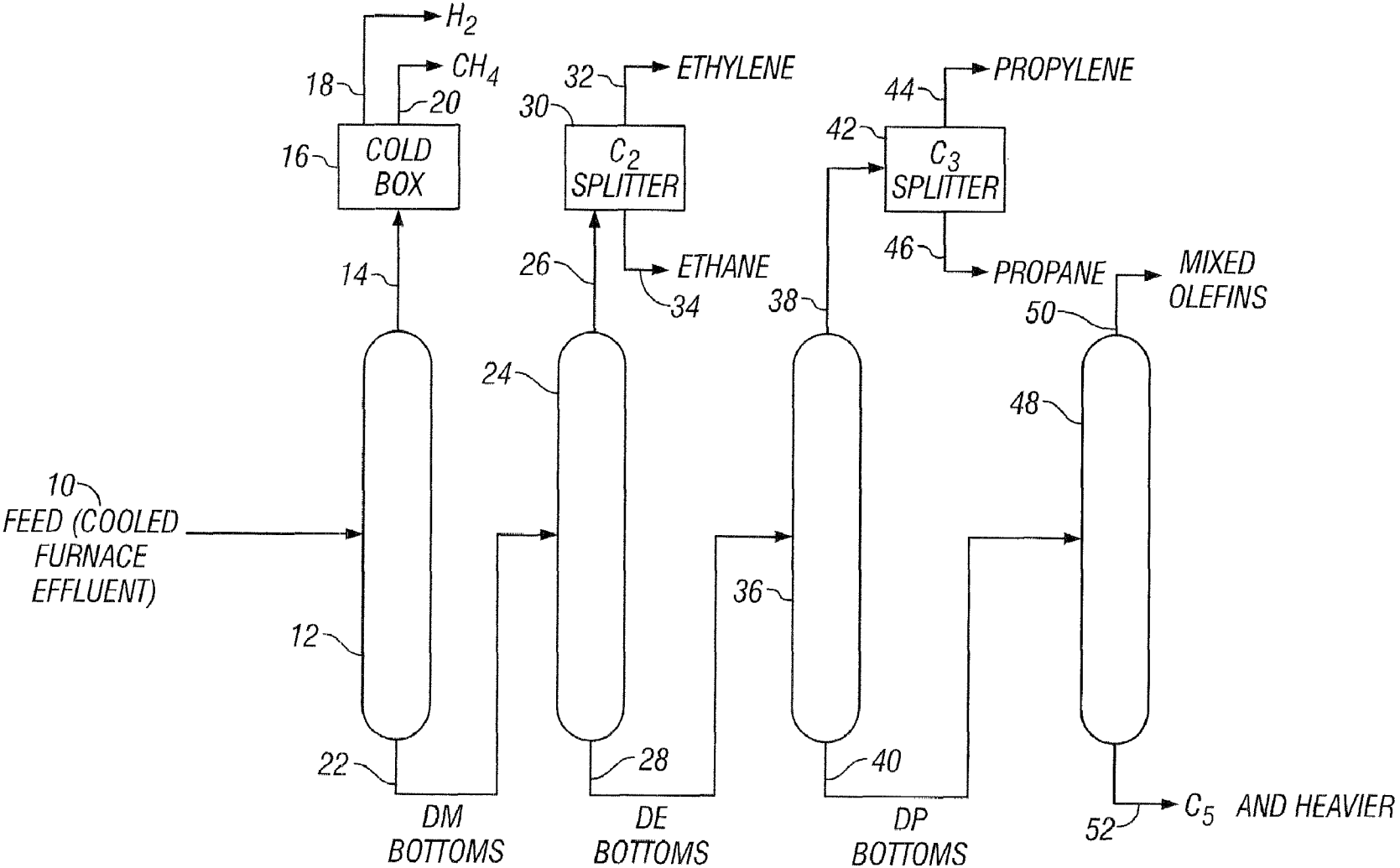
FIG. 1 (Prior Art)
FIG. 1 is a schematic illustration of a prior art ethylene plant featuring a demethanizer, deethanizer, depropanizer, and debutanizer for the recovery of olefins from cracking furnace effluent.

Mole Fraction of Base Case with a Single Original Deethanizer (Ref to FIG. 1)

| | DM bottoms feed (112) | DM stripper bottoms feed (116) | Primary Deethanizer Overhead (128) | Primary Deethanizer Bottoms (120) |
|---|---|---|---|---|
| Acetylene | 0.016 | 0.014 | 0.018 | Trace |
| Ethylene | 0.726 | 0.450 | 0.716 | Trace |
| Ethane | 0.210 | 0.222 | 0.264 | Trace |
| Methyl Acetylene | Trace | 0.007 | Trace | 0.023 |
| Propadiene | Trace | 0.005 | Trace | 0.016 |
| Propylene | 0.033 | 0.142 | 0.002 | 0.475 |
| Propane | 0.011 | 0.054 | Trace | 0.178 |
| Butadiene | 0.002 | 0.040 | Trace | 0.118 |
| Isobutylene | 0.001 | 0.018 | Trace | 0.053 |
| Cyclopentadiene | 0.001 | 0.007 | 0 | 0.021 |
| Isoprene | Trace | 0.008 | Trace | 0.022 |
| Benzene | Trace | 0.024 | 0 | 0.067 |

TABLE 1-continued

| Mole Fraction of Base Case with a Single Original Deethanizer (Ref to FIG. 1) | | | | |
|---|---|---|---|---|
| | DM bottoms feed (112) | DM stripper bottoms feed (116) | Primary Deethanizer Overhead (128) | Primary Deethanizer Bottoms (120) |
| Toluene | Trace | 0.004 | Trace | 0.012 |
| Other hydrocarbons | Trace | 0.005 | Trace | 0.015 |
| Totals (%) | 100% | 100% | 100% | 100% |

EXAMPLE 2

As one example of the present invention, a secondary deethanizer is added to the original (primary) deethanizer of Example 1 for improved removal of ethane from the ethylene stream. Feed conditions in Example 2 are identical to the feed conditions of Example 1 for comparison purposes. Mole fractions of selected streams are given in Table 2. The primary deethanizer of the present example has an inside diameter of 4 m (13 ft) and a height of 38 m (123 ft), and features a total of 63 trays. Demethanizer bottoms 112, consisting of approximately 72.6 mol % ethylene, 21.0 mol % ethane, 3.3 mol % propylene, 1.6 mol % acetylene, and 1.0 mol % propane, are supplied to the primary deethanizer at a rate of 2,975 kgmol/hour (6,558 lbmol/hour), at a temperature of −6° C. (21° F.) and a pressure of 3.1 MPa (449 psia). Similarly, demethanizer stripper bottoms 116, consisting of approximately 45.0 mol % ethylene, 22.2 mol % ethane, 14.2 mol % propylene, 5.4 mol % propane, 4.0 mol % butadiene, 2.4 mol % benzene, 1.8 mol % isobutylene and 1.4 mol % acetylene, are supplied to the primary deethanizer at a rate of 3,063 kgmol/hour (6,752 lbmol/hour), at a temperature of 14° C. (58° F.) and a pressure of 3.1 MPa (449 psia). The primary deethanizer produces an overhead effluent 128 at a rate of 4,816 kgmol/hour (10,618 lbmol/hour) consisting of 73.4 mol % ethylene, 24.5 mol % ethane and 1.8 mol % acetylene, at a temperature −11° C. (11° F.) and a pressure of 2.8 MPa (399 psia). The overhead effluent has a production rate of approximately 2,308 kgmol/hour (5,088 lb/hour acetylene), 99,182 kgmol/hour (218,660 lb/hour) ethylene and 35,538 kgmol/hour (78,349 lb/hour of ethane). The overhead vapor is supplied to a C2 splitter, which separates the ethylene and ethane, with the ethylene being collected as product and the ethane either being recycled to the cracking furnace or supplied as fuel.

Primary deethanizer bottoms 120, consisting of 42.8 mol % propylene, 16 mol % propane, 10.6 mol % butadiene, 9.9 mol % ethane, 6.0 mol % benzene, 4.8 mol % isobutylene, 2.1 mol % methyl acetate, 2.0 mol % isoprene, 1.9 mol % cyclopentadiene, and 1.4 mol % propadiene, and having a temperature of 74° C. (166° F.) and a pressure of 2.8 MPa (409 psia), are cooled by indirect heat exchange with chilled water to a temperature of 60° C. (140° F.) and a pressure of 2.8 MPa (406 psia). The primary deethanizer bottoms are then supplied to the secondary deethanizer at a rate of 1,221 kgmol/hour (2,692 lbmol/hour) and a temperature of 36° C. (97° F.) and pressure of 1.2 MPa (180 psia).

The secondary deethanizer of the present example has an inside diameter of 1.8 m (6 ft) and a height of 29 m (95 ft), and features a total of 45 trays. The secondary deethanizer produces an overhead vapor product 154 consisting of 94.3% ethane, 4.1% propylene, 0.9% ethylene and 0.6% propane, as well as trace amounts of other compounds, at a temperature of −24° C. (−11° F.) and a pressure of 1.1 MPa (160 psia). The overhead vapor is produced at a rate of 128 kgmol/hour (282 lbmol/hour). Secondary deethanizer bottoms 144, consisting of 47.3 mol % propylene, 17.8 mol % propane, 11.9 mol % butadiene, 6.7 mol % benzene, 5.4 mol % isobutylene, 2.3 mol % methyl acetate, 2.2 mol % isoprene, 2.1 mol % cyclopentadiene, 1.6 mol % propadiene, 1.2 mol % toluene, and trace amounts of other compounds, having a temperature of 40° C. (104° F.) and a pressure of 1.2 MPa (168 psia), are produced at a total flow rate of 1,093 kgmol/hour (2,410 lbmol/hour). The secondary deethanizer overhead effluent has a production rate of approximately 33.2 kg/hour (73.2 lb/hour ethylene) and 3,629 kg/hour (8,001 lb/hour) of ethane. Total collected C2 product from the overhead effluent of the primary and secondary deethanizers in this example is approximately 2,308 kg/hour (5,088 lb/hour) acetylene, 99,215 kg/hour (218,733 lb/hour) ethylene, and 39,167 kg/hour (86,350 lb/hour) ethane.

TABLE 2

| Mole Fraction of Plant with Secondary Deethanizer (Ref. to FIG. 2) | | | | | | |
|---|---|---|---|---|---|---|
| | DM bottoms feed (112) | DM stripper bottoms feed (116) | Primary Deethanizer Overhead (128) | Primary Deethanizer Bottoms (120) | Secondary Deethanizer Overhead (154) | Secondary Deethanizer Bottoms (144) |
| Acetylene | 0.016 | 0.014 | 0.018 | Trace | Trace | Trace |
| Ethylene | 0.726 | 0.450 | 0.734 | 0.001 | 0.009 | Trace |
| Ethane | 0.210 | 0.223 | 0.245 | 0.099 | 0.943 | Trace |
| Methyl Acetylene | Trace | 0.007 | Trace | 0.028 | Trace | 0.023 |
| Propadiene | Trace | 0.005 | Trace | 0.014 | Trace | 0.016 |
| Propylene | 0.033 | 0.142 | 0.002 | 0.428 | 0.041 | 0.473 |
| Propane | 0.011 | 0.054 | Trace | 0.160 | 0.006 | 0.179 |
| Butadiene | 0.002 | 0.040 | Trace | 0.106 | Trace | 0.119 |
| Isobutylene | 0.001 | 0 | 0 | 0.048 | Trace | 0.054 |
| Cyclopentadiene | 0.001 | 0.007 | Trace | 0.019 | Trace | 0.021 |
| Isoprene | Trace | 0.008 | Trace | 0.020 | Trace | 0.022 |
| Benzene | Trace | 0 | 0 | 0.060 | Trace | 0.067 |

TABLE 2-continued

| | Mole Fraction of Plant with Secondary Deethanizer (Ref. to FIG. 2) | | | | | |
|---|---|---|---|---|---|---|
| | DM bottoms feed (112) | DM stripper bottoms feed (116) | Primary Deethanizer Overhead (128) | Primary Deethanizer Bottoms (120) | Secondary Deethanizer Overhead (154) | Secondary Deethanizer Bottoms (144) |
| Toluene | Trace | 0 | 0 | 0.011 | Trace | 0.012 |
| Other hydrocarbons | 0.001 | 0.005 | 0.001 | 0.006 | 0.001 | 0.012 |
| Totals (%) | 100% | 100% | 100% | 100% | 100% | 100% |

The operating conditions for Examples 1 and 2 are compared in Table 3. Temperature of the overhead product in the case where the plant includes a secondary deethanizer is relatively unchanged as the first example produces an overhead effluent with a temperature of ° C. (12.1° F.) and in the second example the primary deethanizer produces an overhead effluent with a temperature of ° C. (11.4° F.). However, overhead flow is reduced as Example 1 produces a vapor flow of 4,938 kgmol/hour (10,887 lbmol/hour) and a liquid flow of 2,503 kgmol/hour (5,519 lbmol/hour) compared with Example 2 where the overhead vapor flow is 4,816 kgmol/hour (10,618 lbmol/hour) and the liquid flow is 2,291 kgmol/hour (5,050 lbmol/hour).

The secondary deethanizer decreases the bottoms temperatures by approximately 12° C. (22° F.), from 86.7° C. (188° F.) in Example 1 to 74.4° C. (166° F.) in Example 2. Condenser duty is reduced from GJ/hour (MMBtu/hour) in Example 1 to approximately GJ/hour (MMBtu/hour) in the second example. Reboiler duty was decreased from 46 GJ/hour (43.6 MMBtu/hour) in the first example to 42.3 GJ/hour (40.1 MMBtu/hour) in the second example.

TABLE 3

| | Primary Deethanizer Operating Conditions. | | | | |
|---|---|---|---|---|---|
| | Overhead effluent temperature ° C. (° F.) | Primary deethanizer bottoms temperature ° C. (° F.) | Overhead vapor flow (kgmol/hr) | Overhead liquid flow (kgmol/hr) | Bottom liquid flow (kgmol/hr) |
| Single deethanizer (Example 1) | −11° C. (12.1° F.) | 86.7° C. (188° F.) | 4,933 | 2,503 | 11,577 |
| Primary and secondary deethanizers (Example 2) | −11.4° C. (11.4° F.) | 74° C. (166° F.) | 4,816 | 2,291 | 11,578 |

The invention is described above in reference to specific examples and embodiments. The metes and bounds of the invention are not to be limited by the foregoing disclosure, which is illustrative only, but should be determined in accordance with the full scope and spirit of the appended claims. Various modifications will be apparent to those skilled in the art in view of the description and examples. It is intended that all such variations within the scope and spirit of the appended claims be embraced thereby.

The invention claimed is:

1. A process for deethanizing a light hydrocarbon stream comprising olefins, comprising:

feeding one or more light hydrocarbon streams comprising ethylene, ethane, propylene and propane to a primary deethanizer having absorption and stripping sections at a primary deethanizer pressure;

refluxing the absorption section of the primary deethanizer to produce a rectified stream or streams containing less than 1 mole percent propylene and propane, wherein the rectified stream or streams together comprise from 80 to 99 percent of the feed ethane;

reboiling the stripping section of the primary deethanizer to produce a primary deethanizer bottoms stream comprising from 1 to 20 percent of the feed ethane;

feeding the primary deethanizer bottoms stream to a secondary deethanizer having absorption and stripping sections at a pressure less than the primary deethanizer pressure;

refluxing the absorption section of the secondary deethanizer to produce an overhead vapor stream of ethane essentially free of ethylene; and reboiling the stripping section of the secondary deethanizer to produce a deethanized stream essentially free of ethane.

2. The process of claim 1 wherein the primary deethanizer reboiling is at a temperature less than 80° C. (175° F.).

3. The process of claim 1 wherein heat for the secondary deethanizer reboiling is supplied by hot water.

4. The process of claim 1 wherein heat for the secondary deethanizer reboiling is supplied by condensing propylene refrigerant.

5. The process of claim 1 wherein the heat for the primary deethanizer reboiling is provided by steam.

6. The process of claim 1 wherein the primary deethanizer bottoms stream comprises from 10 to 12 percent of the feed ethane and the overhead vapor stream from the secondary deethanizer comprises less than 1 mole percent ethylene.

7. The process of claim 6 further comprising supplying the overhead vapor stream from the secondary deethanizer to cracking furnace feedstock.

8. The process of claim 6 further comprising supplying the overhead vapor stream from the secondary deethanizer to burner fuel.

9. The process of claim 6 wherein the deethanized stream comprises less than 0.5 mole percent ethane.

10. In a process for recovering ole fins from a cracking furnace effluent, comprising compression of the effluent with a process gas compressor followed by fractionation in a demethanizer, deethanizer, depropanizer, debutanizer, C2 splitter and C3 splitter to obtain purified streams of at least ethane, ethylene, propane, and propylene, the improvement wherein the fractionation in a deethanizer comprises:

feeding one or more light hydrocarbon streams comprising ethylene, ethane, propylene and propane to a primary deethanizer having absorption and stripping sections at a primary deethanizer pressure;

refluxing the absorption section of the primary deethanizer to produce a rectified stream or streams containing less than 1 mole percent propylene and propane, wherein the rectified stream or streams together comprise from 80 to 99 percent of the feed ethane;

reboiling the stripping section of the primary deethanizer to produce a primary deethanizer bottoms stream comprising from 1 to 20 percent of the feed ethane;

feeding the primary deethanizer bottoms stream to a secondary deethanizer having absorption and stripping sections at a pressure less than the primary deethanizer pressure;

refluxing the absorption section of the secondary deethanizer to produce an overhead vapor stream of ethane essentially free of ethylene; and reboiling the stripping section of the secondary deethanizer to produce a deethanized stream essentially free of ethane.

11. The improvement of claim 10 further comprising removing the overhead ethane stream from the process.

12. The improvement of claim 11 further comprising feeding the overhead ethane stream to the cracking furnace.

13. The improvement of claim 10 wherein the secondary deethanizer is refluxed with liquid ethane recovered from the C2 splitter.

14. The improvement of claim 10 wherein the process employs a front-end demethanizer, from 10 to 12 percent of the feed ethane is recovered in the primary deethanizer bottoms stream, and the primary deethanizer reboiling is at a temperature less than 80° C. (175° F.).

15. The improvement of claim 10 wherein the process employs a front-end demethanizer and heat for the secondary deethanizer reboiling is supplied by hot water.

16. The improvement of claim 10 wherein the process employs a front-end depropanizer and heat for the secondary deethanizer reboiling is supplied by condensing propylene refrigerant.

17. A method for retrofitting an original olefin separation unit, wherein the original olefin separation unit comprises a process gas compressor, a demethanizer, an original deethanizer, a depropanizer, a C2 splitter and a C3 splitter, and the original deethanizer comprises absorption and stripping sections, for the separation of ethylene and ethane from an olefm feed gas stream, comprising the steps of:

installing a secondary deethanizer having absorption and stripping sections downstream from the original deethanizer;

supplying one or more light hydrocarbon streams comprising ethylene, ethane, propylene and propane to the original deethanizer operating as a primary deethanizer, having absorption and stripping sections at a primary deethanizer pressure;

refluxing the absorption section of the primary deethanizer to produce a rectified stream or streams containing less than 1 mole percent propylene and propane, wherein the rectified stream or streams together comprise from 80 to 99 percent of the feed ethane;

reboiling the stripping section of the primary deethanizer to produce a primary deethanizer bottoms stream comprising from 1 to 20 percent of the feed ethane;

supplying the primary deethanizer bottoms stream to the secondary deethanizer;

refluxing the absorption section of the secondary deethanizer to produce an overhead vapor stream of ethane essentially free of ethylene; and reboiling the stripping section of the secondary deethanizer to produce a deethanized stream essentially free of ethane.

18. The method of claim 17 wherein the primary deethanizer bottoms stream comprises from 10 to 12 percent of the feed ethane and the overhead vapor stream from the secondary deethanizer comprises less than 1 mole percent ethylene.

19. The method of claim 18 further comprising supplying the overhead vapor stream from the secondary deethanizer to cracking furnace feedstock.

20. The method of claim 17 wherein the deetbanized stream comprises less than 0.5 mole percent ethane.

21. The method of claim 17 wherein the primary deethanizer boiling is at a temperature less than 80° C. (175° F.).

* * * * *